US006456243B1

(12) United States Patent
Poilasne et al.

(10) Patent No.: US 6,456,243 B1
(45) Date of Patent: Sep. 24, 2002

(54) MULTI FREQUENCY MAGNETIC DIPOLE ANTENNA STRUCTURES AND METHODS OF REUSING THE VOLUME OF AN ANTENNA

(75) Inventors: Gregory Poilasne; Laurent Desclos, both of Los Angeles; Sebastian Rowson, Santa Monica, all of CA (US)

(73) Assignee: Ethertronics, Inc., San Diego, CA (US)

( * ) Notice: Subject to any disclaimer, the term of this patent is extended or adjusted under 35 U.S.C. 154(b) by 0 days.

(21) Appl. No.: 09/892,928

(22) Filed: Jun. 26, 2001

(51) Int. Cl.[7] ..... H01Q 1/38
(52) U.S. Cl. ..... 343/700 MS; 343/702
(58) Field of Search ..... 343/702, 700 MS, 343/767, 770

(56) References Cited

U.S. PATENT DOCUMENTS

| | | | | | |
|---|---|---|---|---|---|
| 3,721,990 | A | | 3/1973 | Gibson et al. | 343/726 |
| 4,684,952 | A | * | 8/1987 | Munson et al. | 343/700 MS |
| 5,450,090 | A | | 9/1995 | Gels et al. | 343/700 MS |
| 5,627,550 | A | * | 5/1997 | Sanad | 343/700 MS |
| 5,781,158 | A | * | 7/1998 | Ko et al. | 343/700 MS |
| 5,943,020 | A | | 8/1999 | Liebendoerfer et al. | 343/702 |
| 6,008,762 | A | | 12/1999 | Nghiem | 343/700 MS |
| 6,114,996 | A | * | 9/2000 | Nghiem | 343/700 MS |
| 6,133,880 | A | * | 10/2000 | Grangeat et al. | 343/700 MS |
| 6,195,051 | B1 | | 2/2001 | McCoy et al. | 343/700 MS |
| 6,323,810 | B1 | * | 11/2001 | Poilasne | 343/700 MS |

* cited by examiner

*Primary Examiner*—Tan Ho
(74) *Attorney, Agent, or Firm*—Blakely Sokoloff Taylor & Zafman LLP

(57) ABSTRACT

Various resonant modes of a multiresonant antenna structure share at least portions of the structure volume. The basic antenna element has a ground plane and a pair of spaced-apart conductors electrically connected to the ground plane. Additional elements are coupled to the basic element, such as by stacking, nesting or juxtaposition in an array. In this way, individual antenna structures share common elements and volumes, thereby increasing the ratio of relative bandwidth to volume.

24 Claims, 19 Drawing Sheets

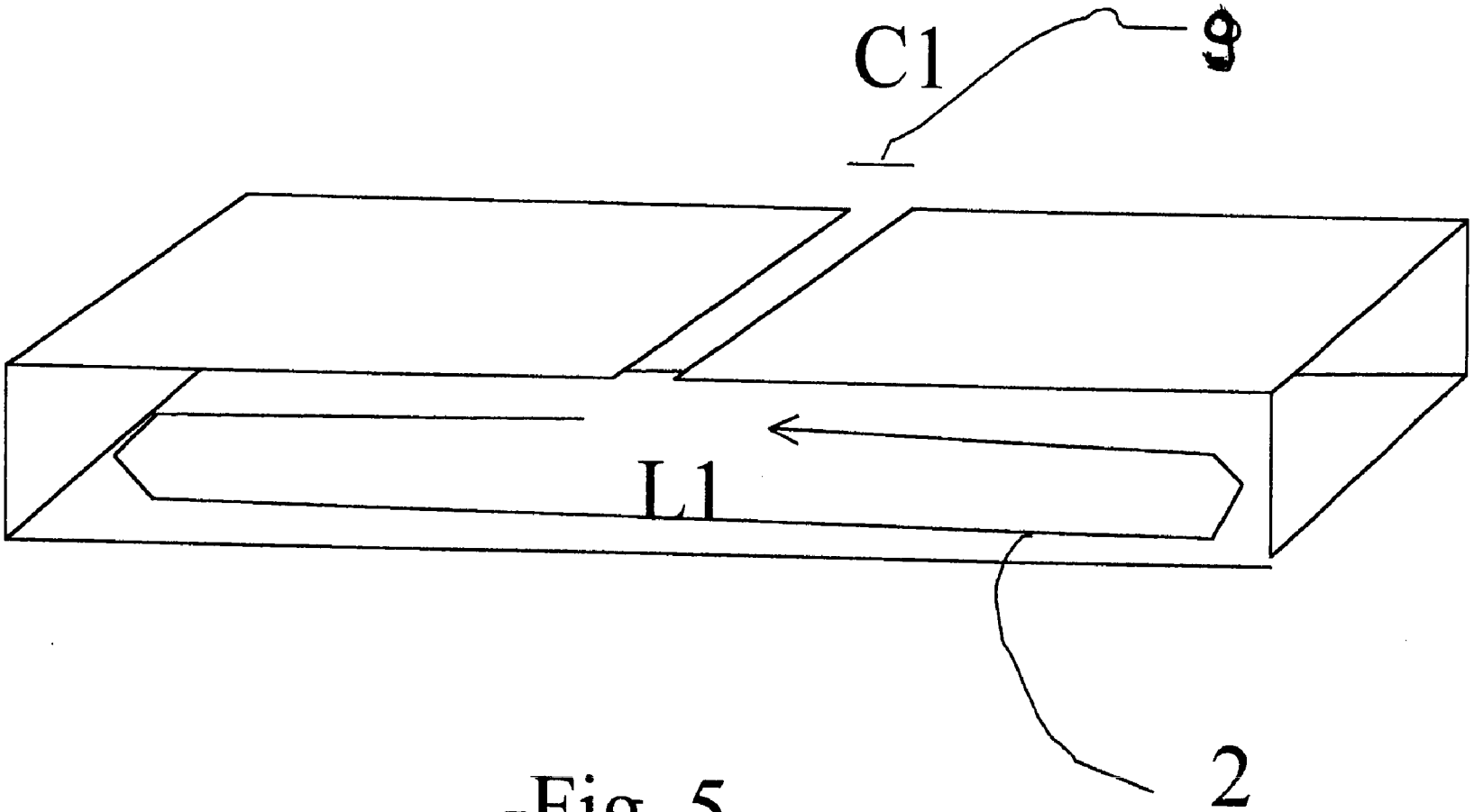
-Fig. 5-

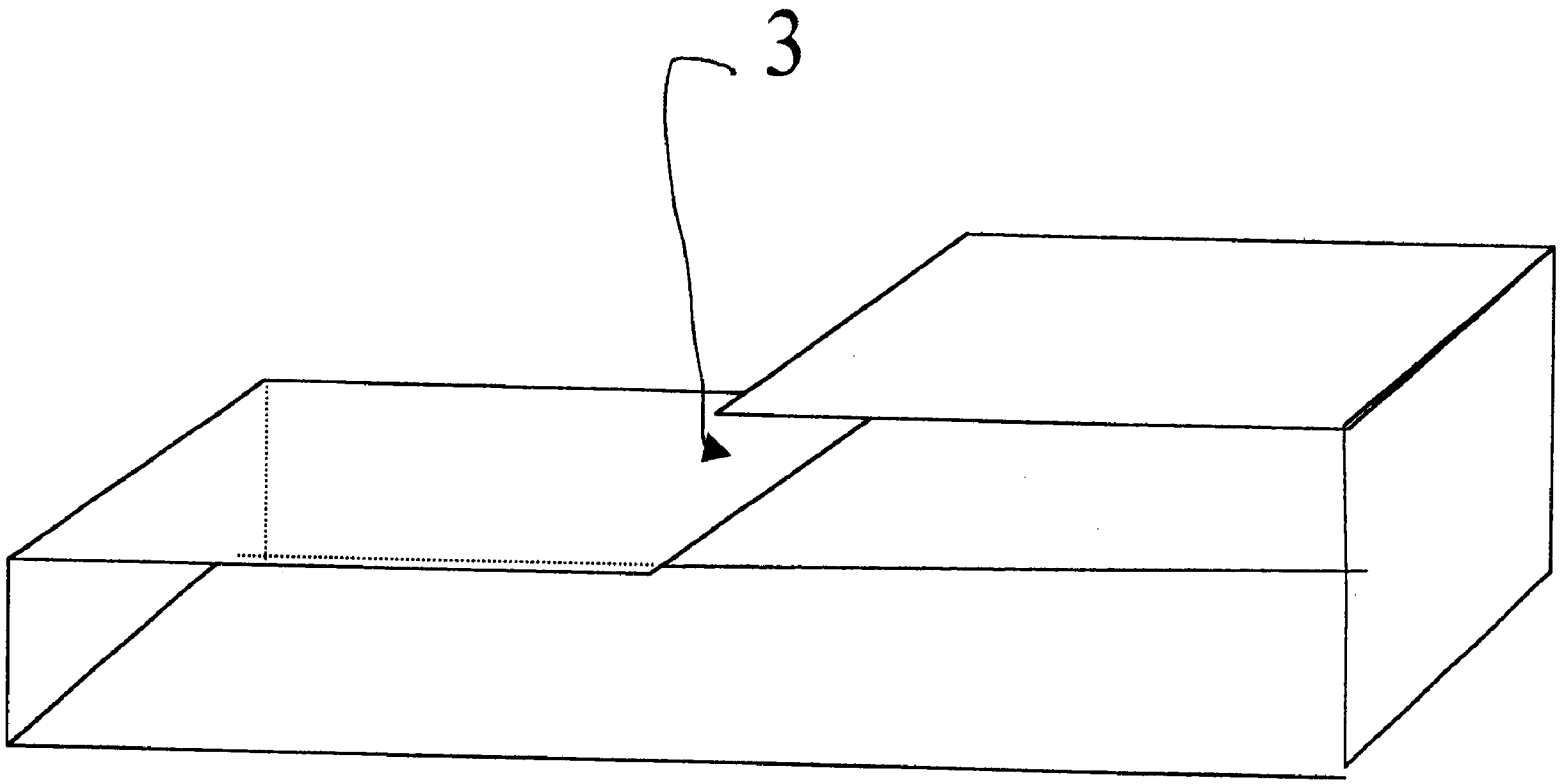
-Fig. 6-

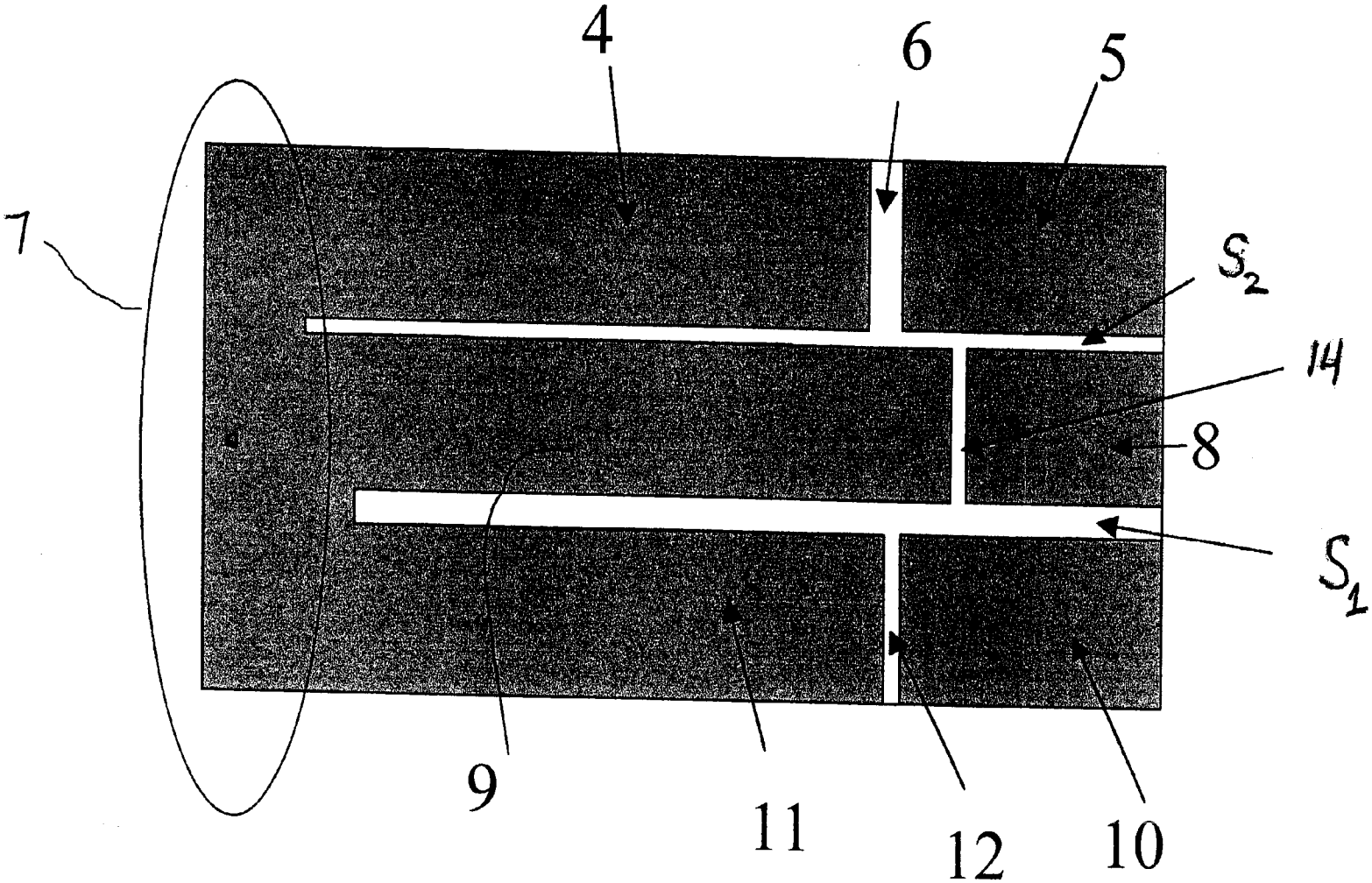
-fig7-

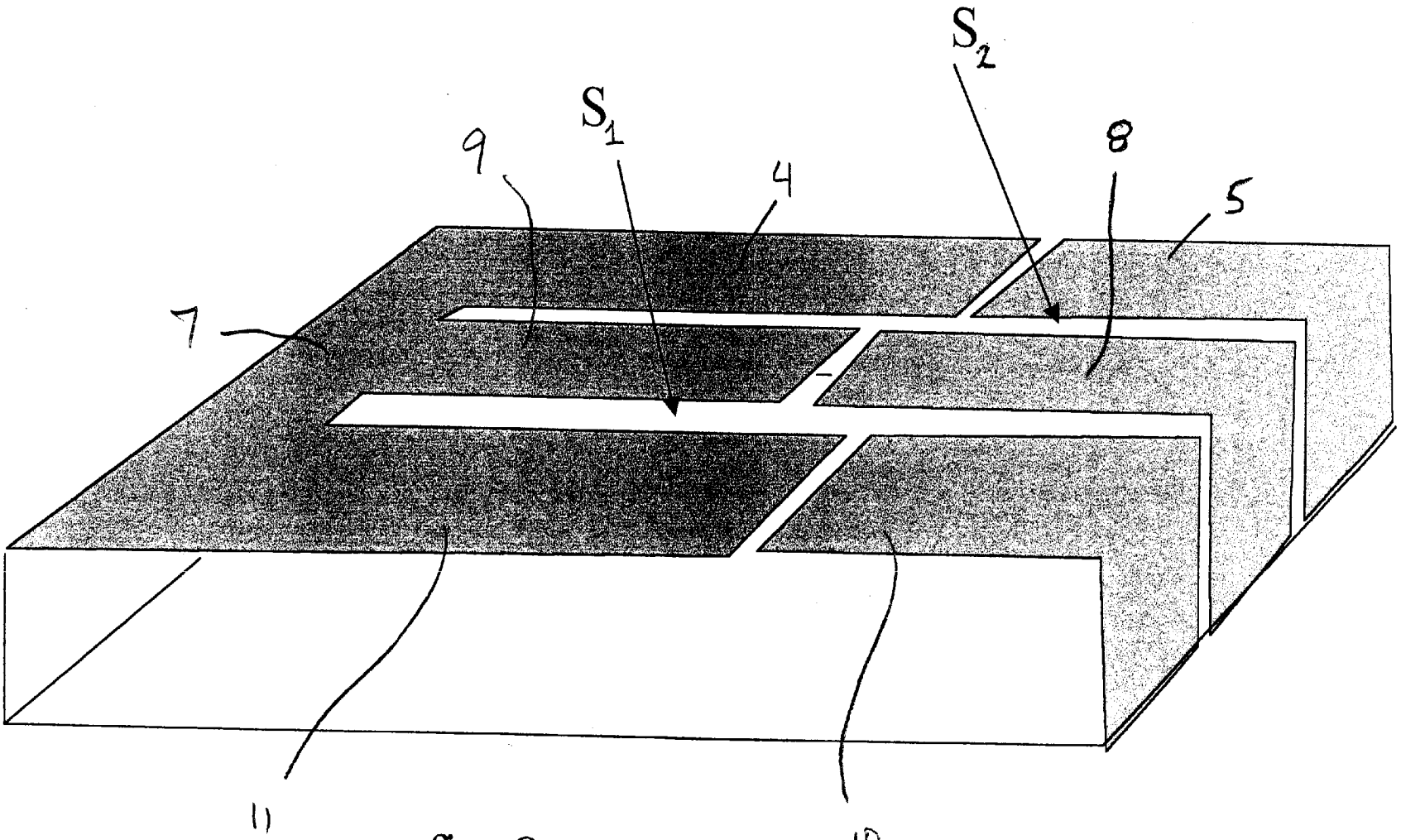
-fig. 8-

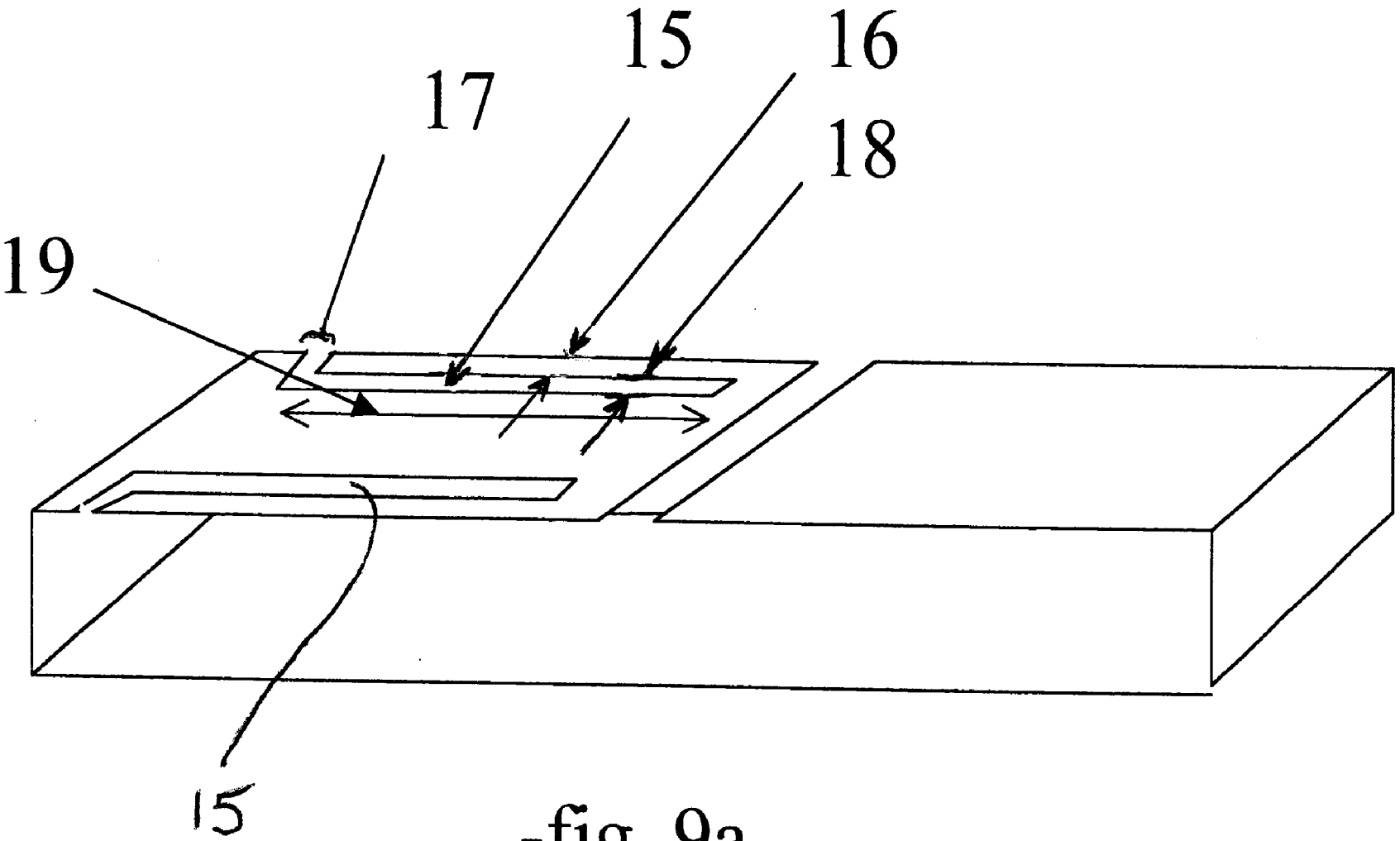
-fig. 9a-

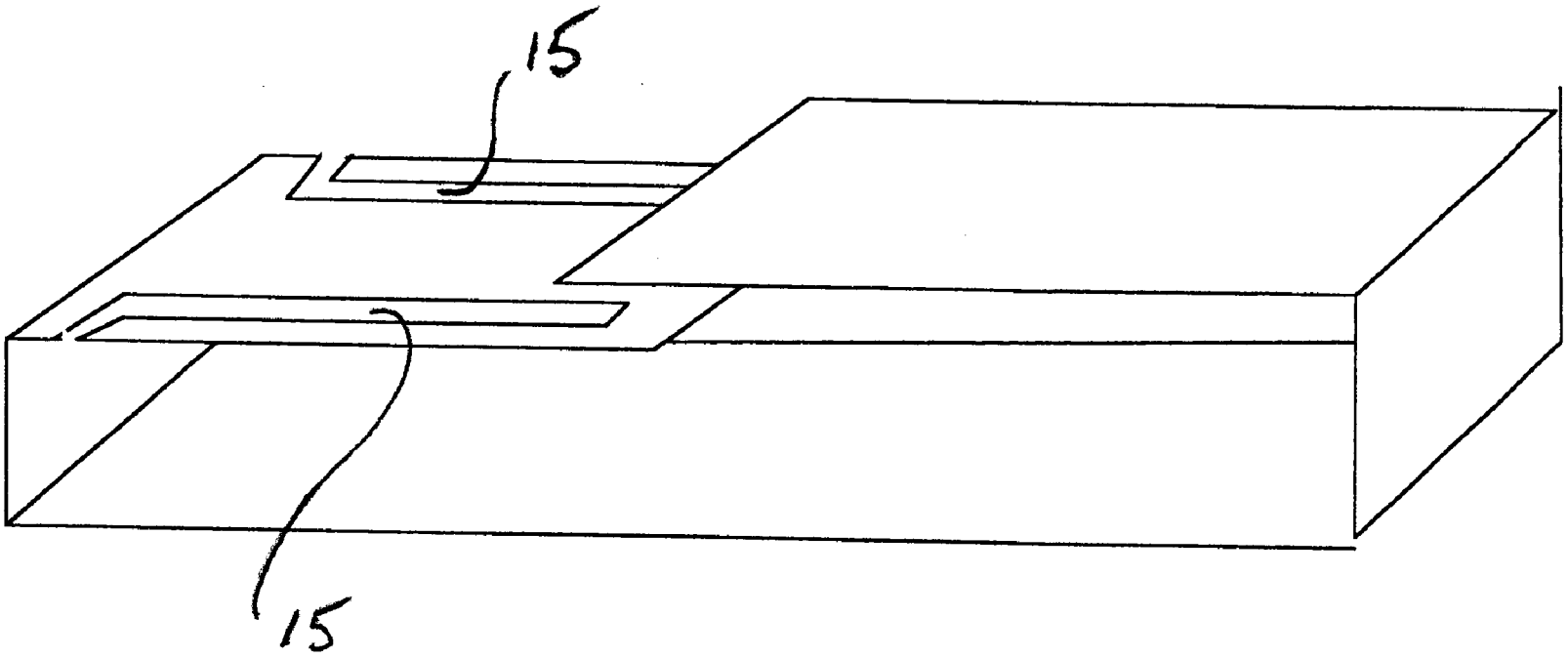
-fig. 9b-

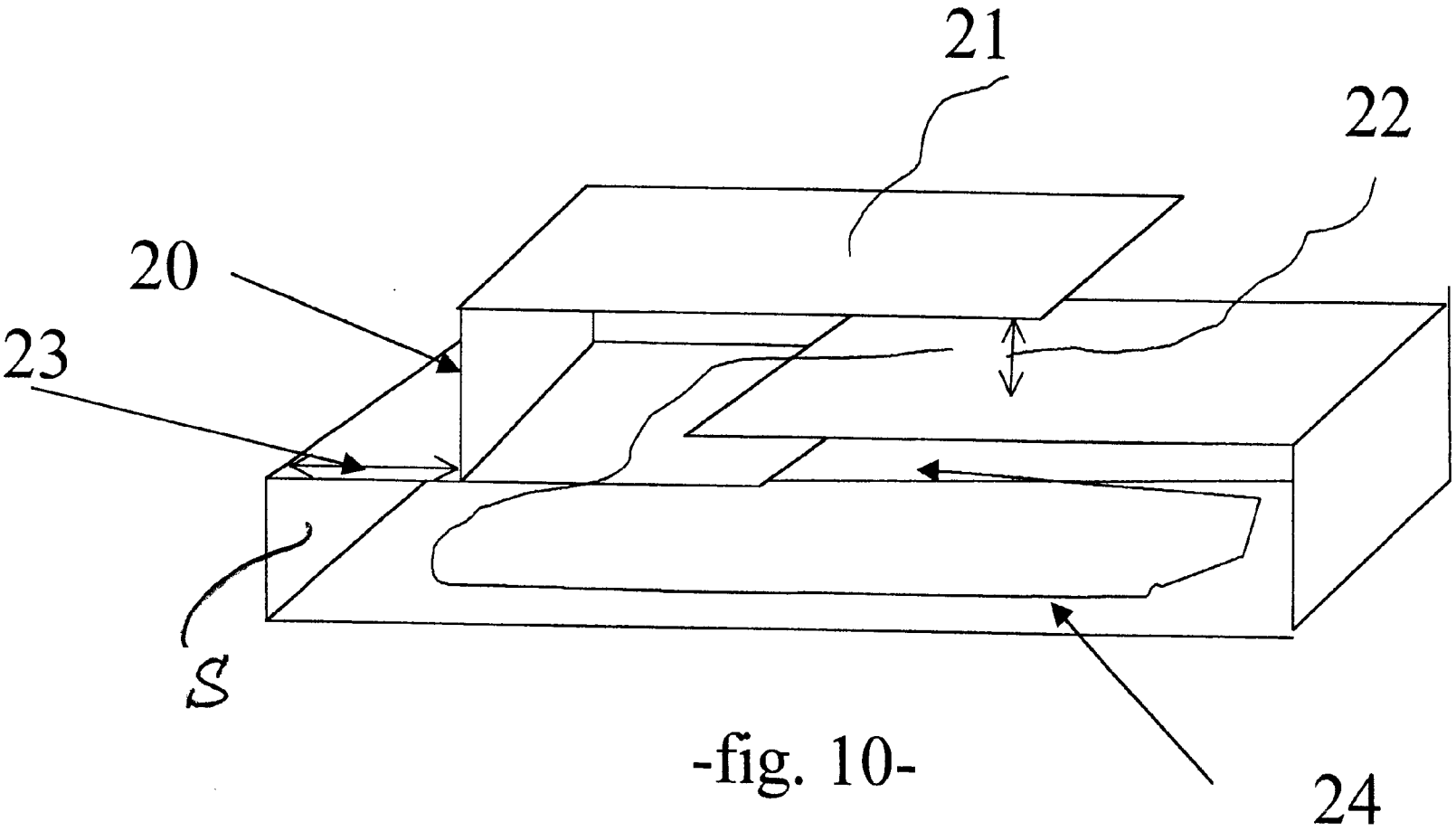
-fig. 10-

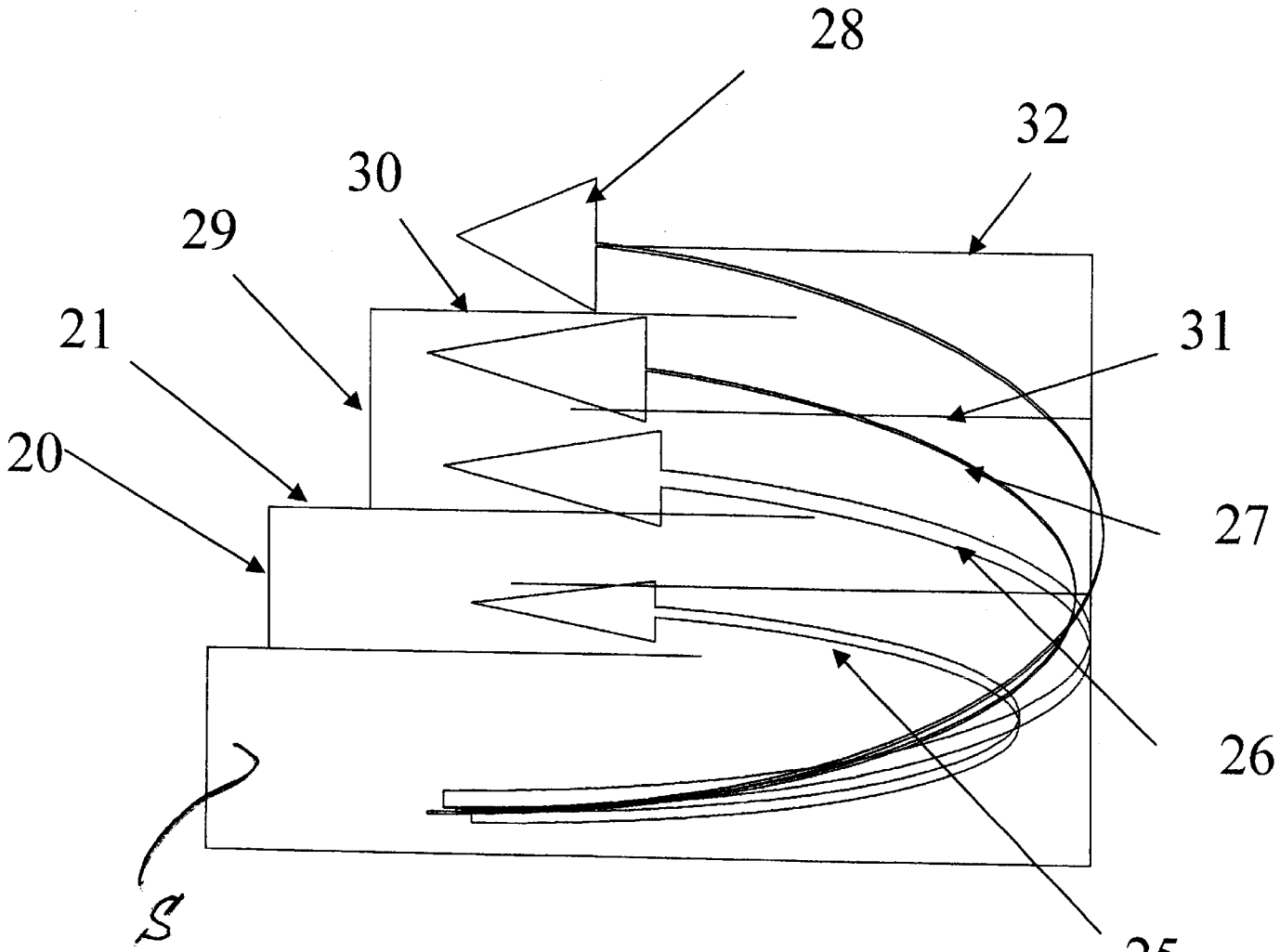
-Fig. 11-

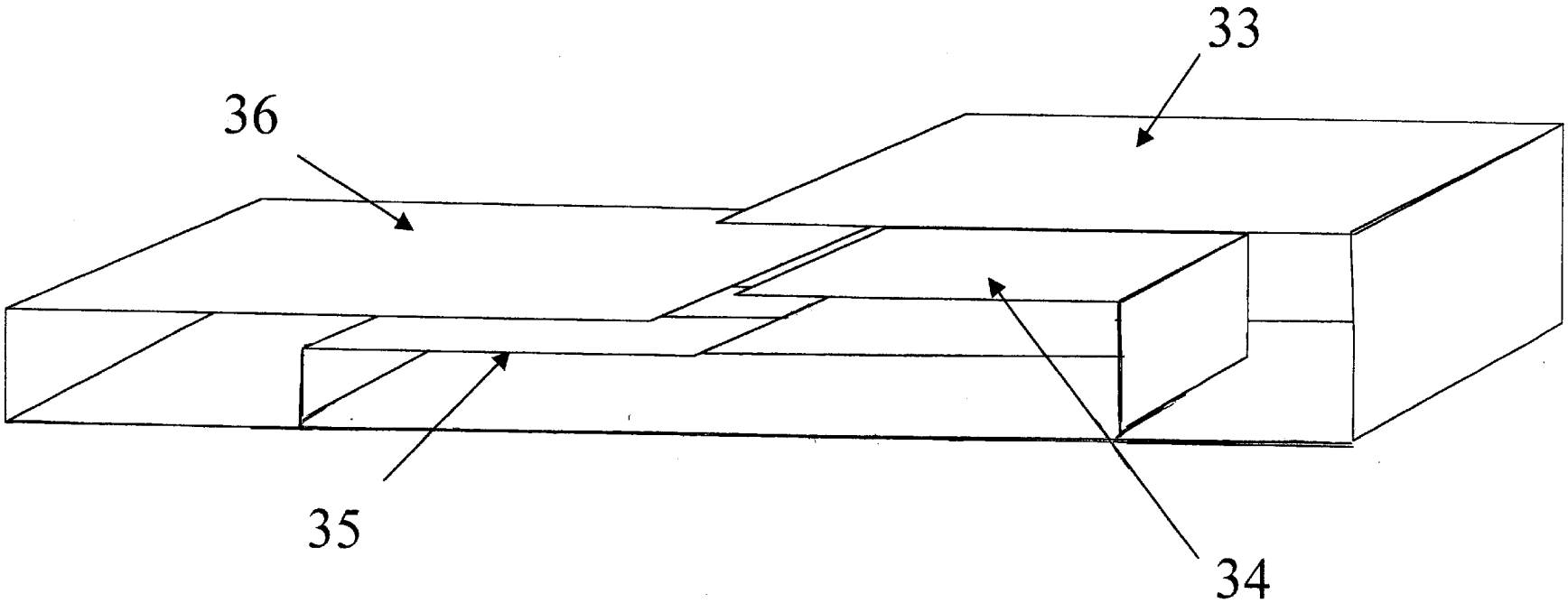
-Fig. 12-

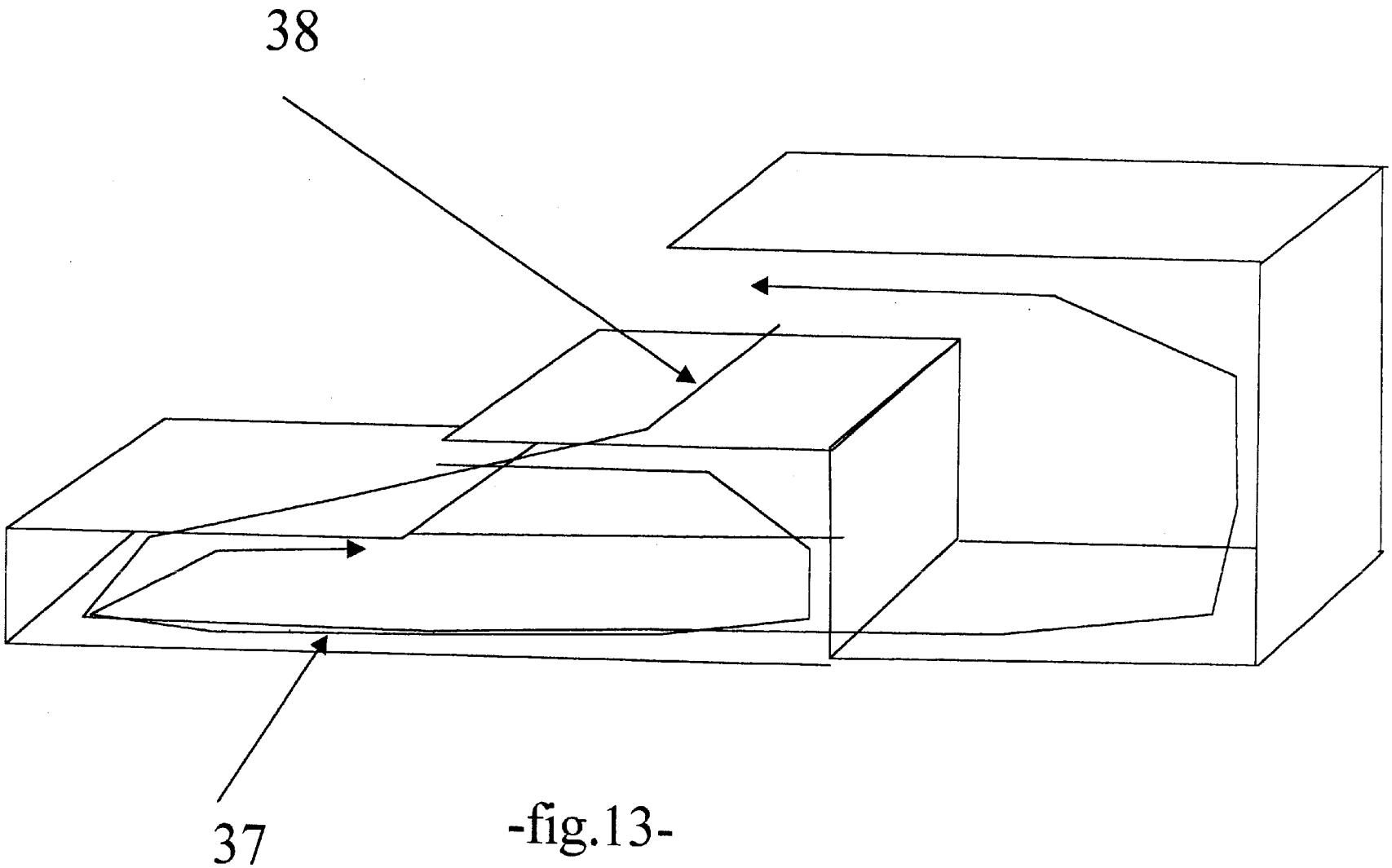
-fig.13-

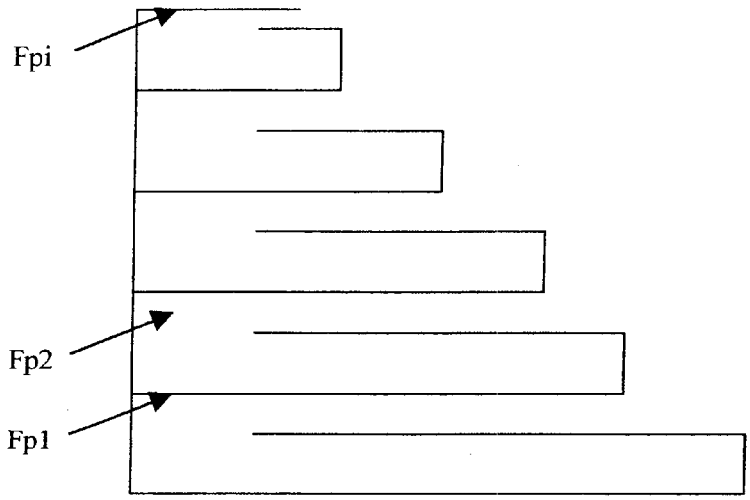
Figure 14
Figure 15a
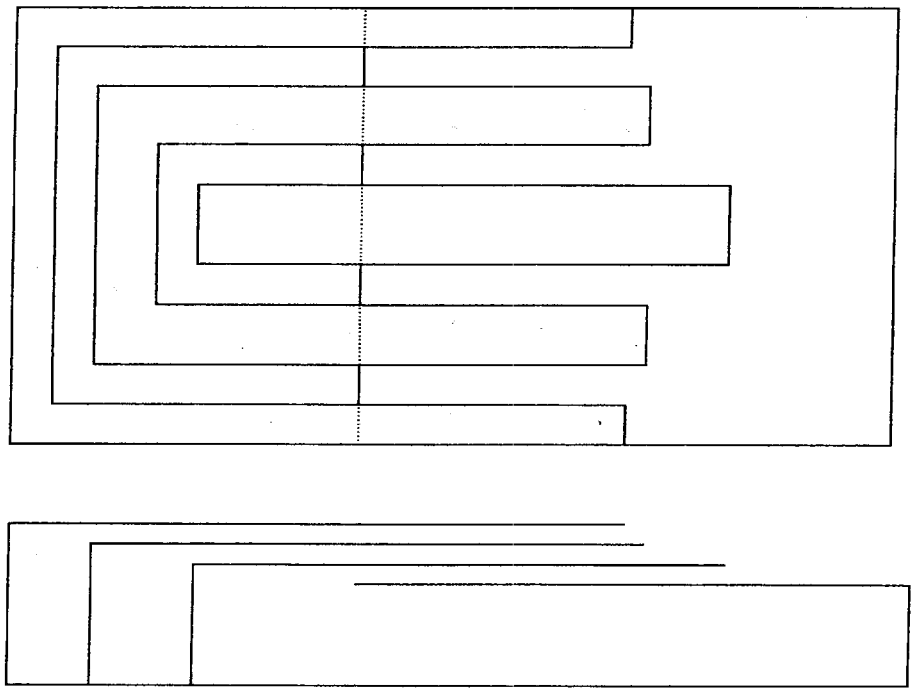
Figure 15b

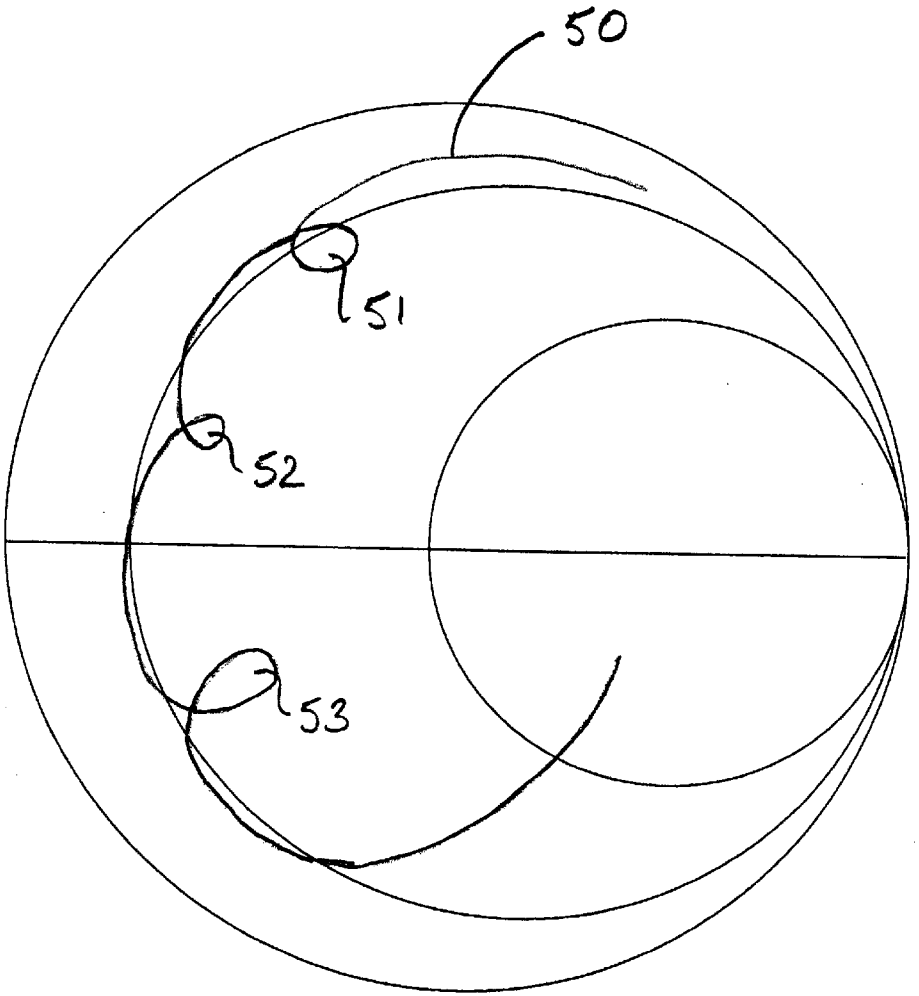
-Fig. 17-

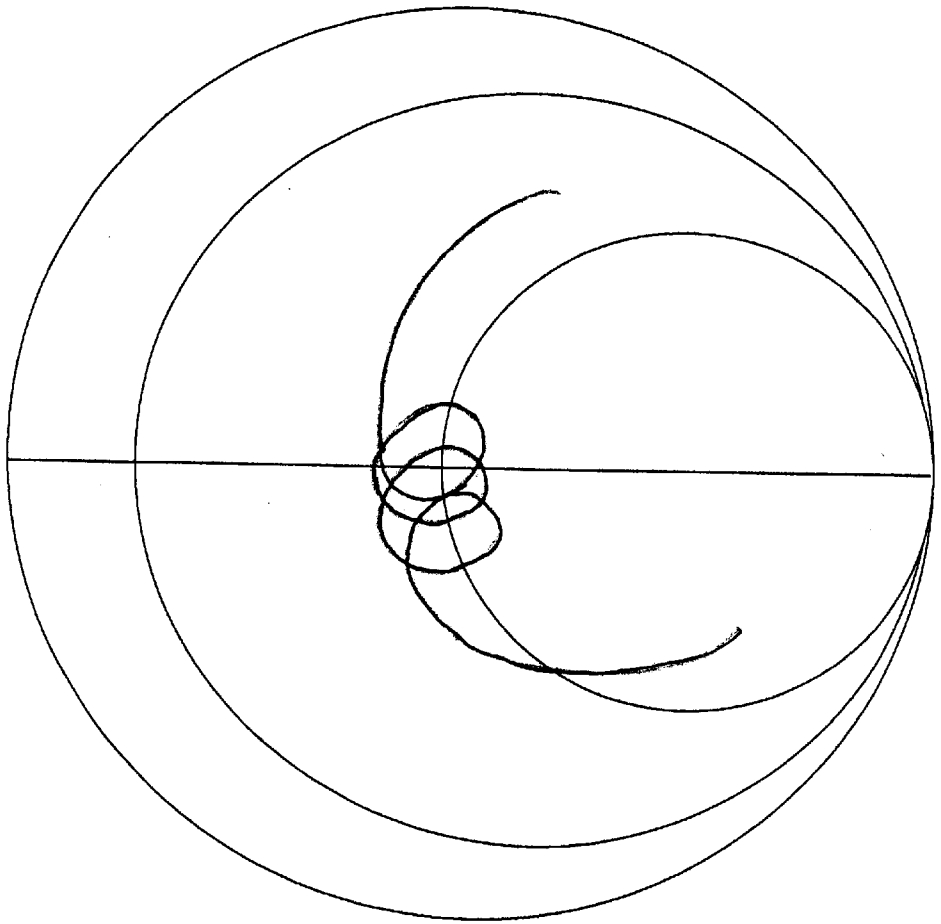
-Fig. 18-

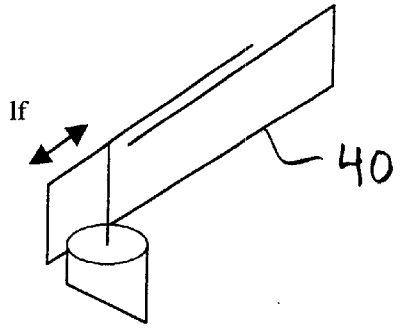
Figure 21
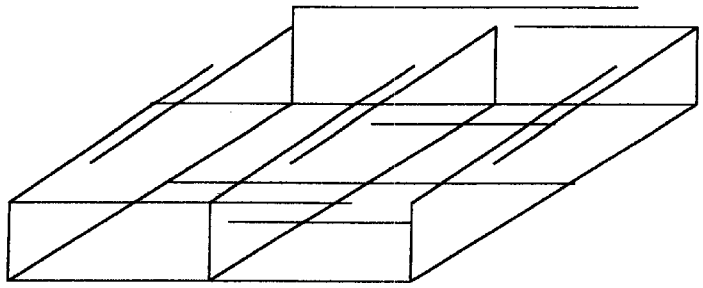
Figure 22
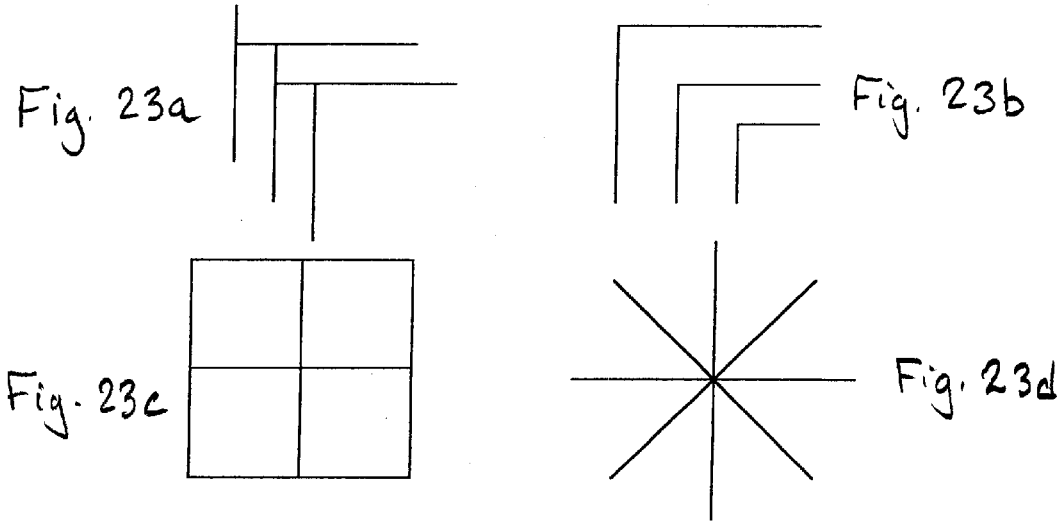

MULTI FREQUENCY MAGNETIC DIPOLE ANTENNA STRUCTURES AND METHODS OF REUSING THE VOLUME OF AN ANTENNA

CROSS REFERENCE TO RELATED APPLICATIONS

This application relates to co-pending application Serial No. 09/901,134, entitled "Multimode Grounded Multifinger Patch Antenna" by Gregory Poilasne et al., owned by the assignee of this application and incorporated herein by reference.

This application also relates to co-pending application Serial No. 09/781,779, entitled "Spiral Sheet Antenna Structure and Method" by Eli Yablonovitch et al., owned by the assignee of this application and incorporated herein by reference.

BACKGROUND OF THE INVENTION

1. Field of the Invention

The present invention relates generally to the field of wireless communications, and particularly to the design of an antenna.

2. Background

Small antennas are required for portable wireless communications. With classical antenna structures, a certain physical volume is required to produce a resonant antenna structure at a particular radio frequency and with a particular bandwidth. A fairly large volume is required if a large bandwidth is desired. Accordingly, the present invention addresses the needs of small compact antenna with wide bandwidth.

SUMMARY OF THE INVENTION

The present invention provides a multiresonant antenna structure in which the various resonant modes share at least portions of the structure volume. The frequencies of the resonant modes are placed close enough to achieve the desired overall bandwidth. Various embodiments are disclosed. The basic antenna element comprises a ground plane; a first conductor extending longitudinally parallel to the ground plane having a first end electrically connected to the ground plane and a second end; a second conductor extending longitudinally parallel to the ground plane having a first end electrically connected to the ground plane and a second end spaced apart from the second end of the first conductor; and an antenna feed coupled to the first conductor. Additional elements are coupled to the basic element, such as by stacking, nesting or juxtaposition in an array. In this way, individual antenna structures share common elements and volumes, thereby increasing the ratio of relative bandwidth to volume.

BRIEF DESCRIPTION OF THE DRAWINGS

FIG. 5 is a perspective view of a basic radiating structure.

FIG. 6 is a perspective view of an alternative basic radiating structure.

FIG. 7 is a top plan view of one embodiment of a multiresonant antenna structure.

FIG. 8 is a perspective view of the antenna structure of FIG. 7.

FIG. 9*a* is a perspective view of another embodiment of a multiresonant antenna structure.

FIG. 9*b* is a perspective view of a further embodiment of a multiresonant antenna structure.

FIG. 10 is a perspective view of still another embodiment of a multiresonant antenna structure.

FIG. 11 is a perspective view of yet another embodiment of a multiresonant antenna structure.

FIG. 12 is a perspective view of another embodiment of a multiresonant antenna structure.

FIG. 13 is a perspective view of another embodiment of a multiresonant antenna structure.

FIG. 14 is a perspective view of another embodiment of a multiresonant antenna structure.

FIGS. 15*a*–*b* are top plan and side views, respectively, of another embodiment of a multiresonant antenna structure.

FIG. 17 is a Smith chart illustrating a non-optimized multiresonant antenna.

FIG. 18 is a Smith chart illustrating an optimized multiresonant antenna.

FIG. 21 illustrates optimization of the feed point of a driven element of the antenna structure of FIG. 16.

FIG. 22 illustrates an antenna structure with a two-dimensional array of radiating elements.

FIGS. 23*a*–23*d* illustrate alternative antenna structures with two-dimensional arrays of radiating elements.

DETAILED DESCRIPTION OF THE INVENTION

In the following description, for purposes of explanation and not limitation, specific details are set forth in order to provide a thorough understanding of the present invention. However, it will be apparent to one skilled in the art that the present invention may be practiced in other embodiments that depart from these specific details. In other instances, detailed descriptions of well-known methods and devices are omitted so as to not obscure the description of the present invention with unnecessary detail.

Figure 1:
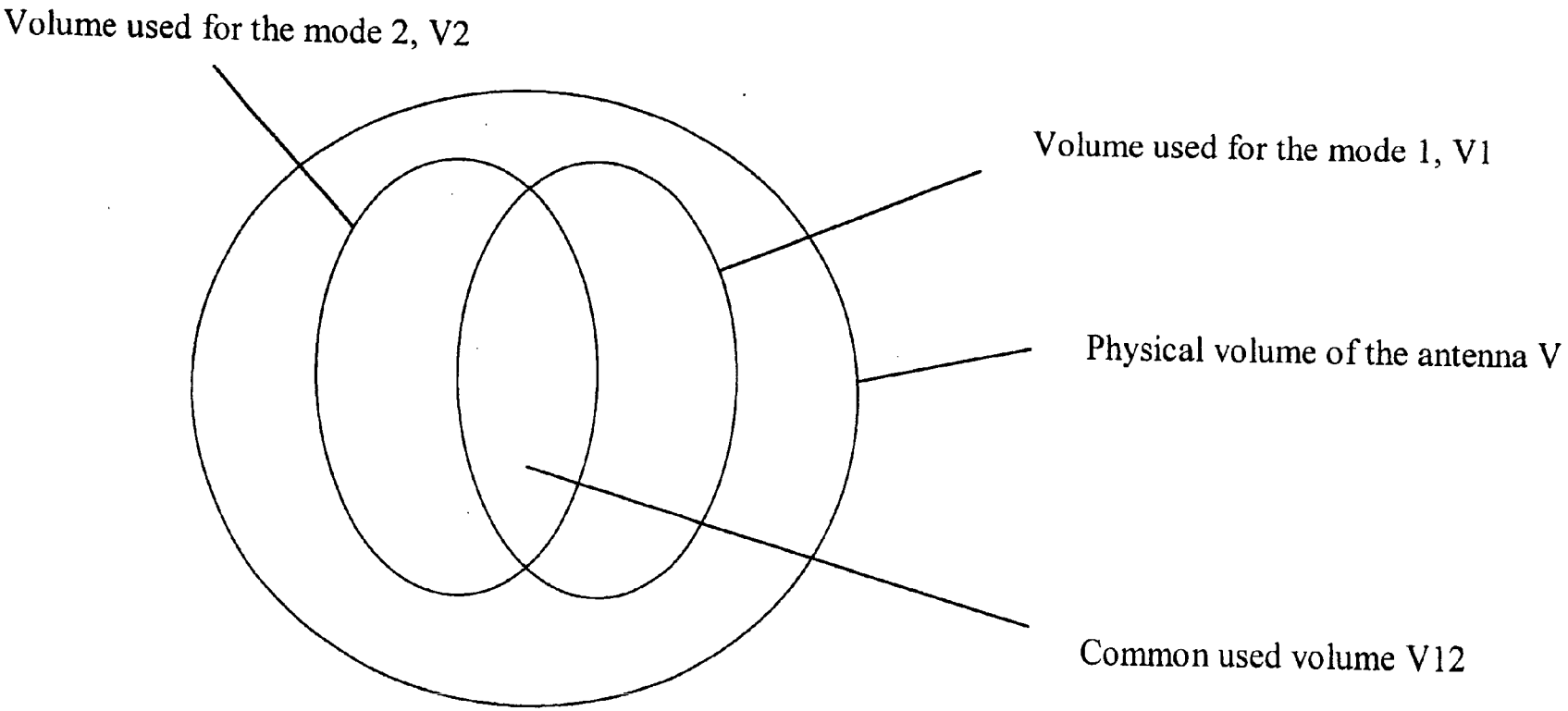
FIG. 1 conceptually illustrates the antenna designs of the present invention.

The volume to bandwidth ratio is one of the most important constraints in modern antenna design. One approach to increasing this ratio is to re-use the volume for different orthogonal modes. Some designs, such as the Grounded Multifinger Patch disclosed in patent application Serial No. 09/801,134, use this approach, even though the designs do not optimize the volume to bandwidth ratio. In the previously mentioned patent application, two modes are generated using the same physical structure, although the modes do not use exactly the same volume. The current repartition of the two modes is different, but both modes nevertheless use a common portion of the available volume. This concept of utilizing the physical volume of the antenna for a plurality of antenna modes is illustrated generally in FIG. 1. V is the physical volume of the antenna, which has two radiating modes. The physical volume associated with the first mode is designated V1, whereas that associated with the second mode is designated V2. It can be seen that a portion of the physical volume, designated V12, is common to both of the modes.

We will express the concept of volume reuse and its frequency dependence with what we refer to as a "K law". The common general K law is defined by the following:

$$\Delta f/f = K \cdot V/\lambda^3$$

$\Delta f/f$ is the normalized frequency bandwidth. $\lambda$ is the wavelength. The term V represents the volume that will enclose the antenna. This volume so far has been a metric and no discussion has been made on the real definition of this volume and the relation to the K factor.

In order to have a better understanding of the K law, different K factors are defined:

$K_{modal}$ is defined by the mode volume $V_i$ and the corresponding mode bandwidth:

$$\Delta f_i/f_i = K_{modal} \cdot V_i/\lambda^3{}_i$$

where i is the mode index. $K_{modal}$ is thus a constant related to the volume occupied by one electromagnetic mode.

$K_{effective}$ is defined by the union of the mode volumes $V_1 \cup V_2 \cup \ldots V_i$ and the cumulative bandwidth. It can be thought of as a cumulative K;

$$\Sigma_i \Delta f_i/f_i = K_{effective} \cdot (V_1 \cup V_2 \cup \ldots V_i)/\lambda_c^3$$

where $\lambda_c$ is the wavelength of the central frequency. $K_{effective}$ is a constant related to the minimum volume occupied by the different excited modes taking into account the fact that the modes share a part of the volume. The different frequencies $f_i$ must be very close in order to have nearly overlapping bandwidths.

$K_{physical}$ or $K_{observed}$ is defined by the structural volume V of the antenna and the overall antenna bandwidth:

$$\Delta f/f = K_{physical} \cdot V/\lambda^3$$

$K_{physical}$ or $K_{observed}$ is the most important K factor since it takes into account the real physical parameters and the usable bandwidth. $K_{physical}$ is also referred to as $K_{observed}$ it is the only K factor that can be calculated experimentally. In order to have the modes confined within the physical volume of the antenna, $K_{physical}$ must be lower than $K_{effective}$. However these K factor are often nearly equal. The best and ideal case is obtained when $K_{physical}$ is approximately equal to $K_{effective}$ and is also approximately equal to the smallest $K_{modal}$. It should be noted that confining the modes inside the antenna is important in order to have a well-isolated antenna.

One of the conclusions from the above calculations is that it is important to have the modes share as much volume as possible in order to have the different modes enclosed in the smallest volume possible.

Figure 2:
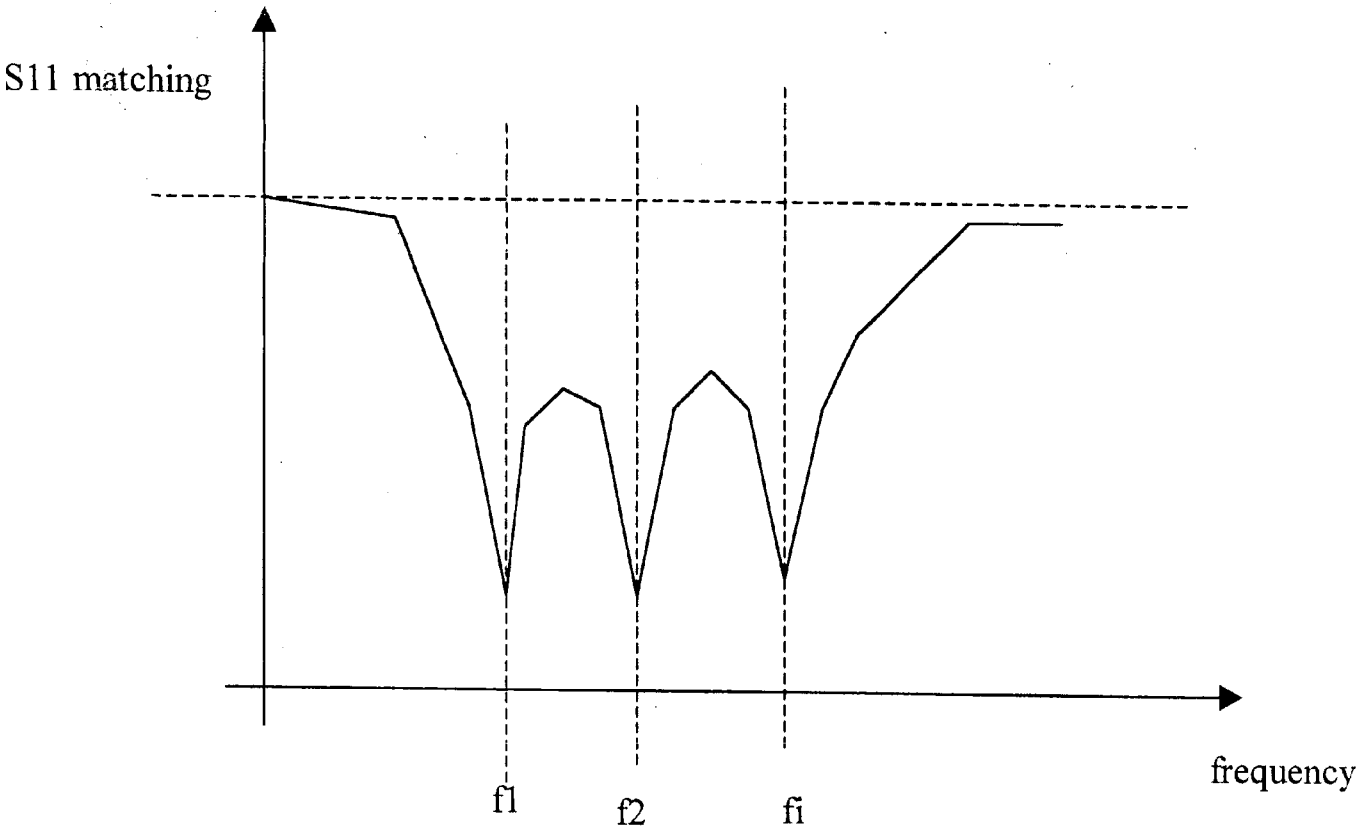
FIG. 2 illustrates the increased overall bandwidth achieved with a multiresonant antenna design.

For a plurality of radiating modes i, FIG. 2 shows the observed return loss of a multiresonant structure. Different successive resonances occur at the frequencies $f_1$, $f_2$, $f_i$, . . . $f_n$. These peaks correspond to the different electromagnetic modes excited inside the structure. FIG. 2 illustrates the relationship between the physical or observed K and the bandwidth over $f_1$ to $f_n$.

Figure 3:
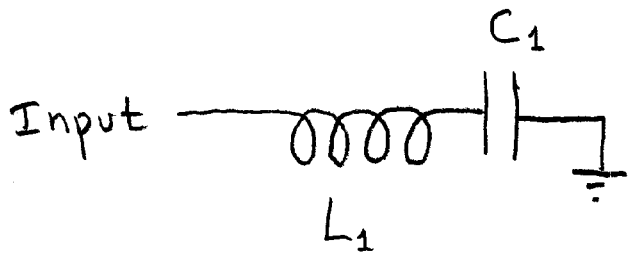
FIG. 3 is an equivalent circuit for a radiating structure.

For a particular radiating mode with a resonant frequency at $f_1$, we can consider the equivalent simplified circuit $L_1C_1$ shown in FIG. 3. By neglecting the resistance in the equivalent circuit, the bandwidth of the antenna is simply a function of the radiation resistance. The circuit of FIG. 3 can be repeated to produce an equivalent circuit for a plurality of resonant frequencies.

Figure 4:
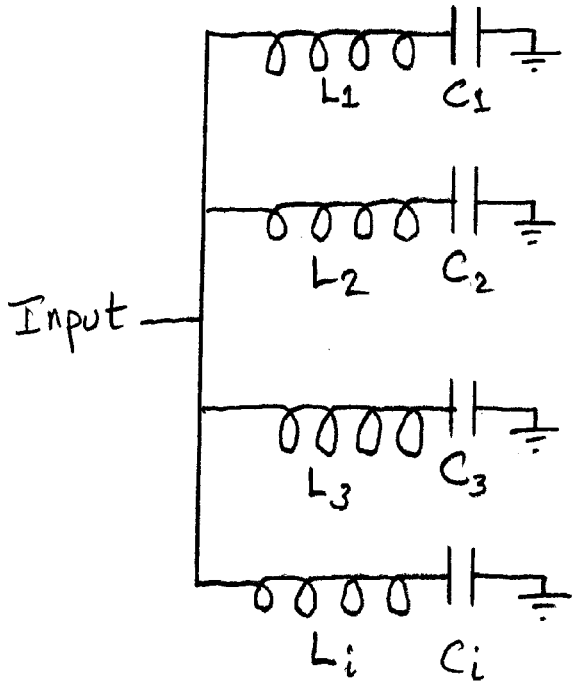
FIG. 4 is an equivalent circuit for a multiresonant antenna structure.

FIG. 4 illustrates a multiresonant antenna represented by a plurality of LC circuits. At the frequency $f_1$ only the circuit $L_1C_1$ is resonating. Physically, one part of the antenna structure resonates at each frequency within the covered spectrum. Again, neglecting real resistance of the structure, the bandwidth of each mode is a function of the radiation resistance.

As discussed above, in order to optimize the K factor, the antenna volume must be reused for the different resonant modes. One example of a multimode antenna utilizes a capacitively loaded microstrip type of antenna as the basic radiating structure. Modifications of this basic structure will be subsequently described. In all of the described examples, the element of the multimode antenna structures have closely spaced resonant frequencies.

FIG. 5 illustrates a single-mode capacitively loaded microstrip antenna. If we assume that the structure in FIG. 5 can be modeled as a $L_1C_1$ circuit, then $C_1$ corresponds to fringing capacitance across gap g. Inductance $L_1$ is mainly contributed by the loop designated by the numeral 2. Another configuration of a capacitively loaded microstrip antenna is illustrated in FIG. 6. The capacitance in this case is a facing capacitance at the overlap designated by the numeral 3.

A top plan view of a tri-mode antenna structure is shown in FIG. 7. This structure comprises three sections corresponding to three different frequencies. The feed is placed in area 7, which is similar to the feed arrangement used for the antennas of FIG. 5 and FIG. 6. This structure has three sets of fingers, 4/5, 8/9, and 10/11, configured similarly to the antenna of Fig ire 5. The different inductances are defined by the lengths of fingers 4, 5, 8, 9, 10 and 11. The different capacitances are defined by the gaps 6, 12 and 14.

FIG. 8 is a perspective view of the antenna structure shown in FIG. 7. In this configuration, there is a separate capacitance and inductance for each of the frequencies. The different $L_i$ and $C_i$ are set in order to have closely spaced frequencies fi. The slots $S_1$ and $S_2$ isolate the different parts of the antenna and therefore separate the frequencies of the antenna. This case shows that it is possible to partially reuse the volume of the antenna structure since the area 7 associated with the feed is common to all of the modes. However, some portions of the volume are dedicated to only one of the frequencies.

Another solution for the reuse of the structure volume is depicted in FIGS. 9*a* and 9*b*. FIG. 9*a* is a variation of the basic structure shown in FIG. 5, whereas FIG. 9*b* is a variation of the basic structure shown in FIG. 6. In each case, slits 15 are placed near the sides of the antenna, along its length. The slits create a resonant structure at one frequency, but are electromagnetically transparent at a second characteristic frequency of the structure. The spacing of the resonant frequencies of the structure is mainly controlled by the dimensions 16, 17, 18 and 19. In both FIGS. 9*a* and 9*b*5, two different antennas can be visualized—one by removing the material in the slits 15, which resonates at a first frequency, and the other by filling in the slits, which resonates at a second frequency. These two antennas in one clearly share the same volute.

An embodiment of a multifrequency antenna structure composed of overlapping structures is shown in FIG. 10. A plate 20 connected to another plate 21 is placed over a structure S like that shown in FIG. 6. The underlying structure S defines a capacitance $C_1$ and an inductance $L_1$ and is resonant at a frequency $f_1$. The plate 20 is placed at a distance 23 from one edge. The plate 21 is placed at a distance 22 from the underlying structure, which defines a second capacitance $C_2$. A second frequency $f_2$ is characterized by the inductance $L_2$ of loop 24 and the capacitance $C_2$ associated with gap 22 (the size of which is exaggerated in the figure). By optimizing $C_1$, $C_2$, $L_1$ and $L_2$ it is possible to achieve a set of two close frequencies that will indeed increase the K factor while reusing the same volume. In this case the volume $V_1$ is included within the volume $V_2$. It should be noted that $f_2$ is not necessarily lower than $f_1$.

FIG. 11 illustrates an extension of the structure shown FIG. 10 in which several plates 20–21, 29–30, 31 and 32 have been superposed on an underlying structure S to create a plurality of loops 25, 26, 27, 28. Each of these loops is associated with a different resonant frequency. This concept can be extended to an arbitrary number of stacked loops.

FIG. 12 illustrates an antenna having a first structure 34 of the type shown in FIG. 5 included within a second such structure 33. The feeding point could be coupled to the end of either plate 35 or plate 36 or along any of the open edges. Here, the volume of one antenna is completely included in the volume of the other.

FIG. 13 illustrates another embodiment in which a plurality of structures share common parts and volumes. In this case, the loops associated with the characteristic inductance 3 of the structures are numbered 37 and 38. This concept can be extended to more than two frequencies. The dimensions of the structures may be adjusted to achieve the desired capacitance values as previously described. It should be noted that the selected dimensions may give rise parasitic frequencies and that these may be used in adjusting the overall antenna characteristics.

Another approach to making a multiresonant antenna is illustrated in FIG. 14. Here, multiple antennas are combined in such a way that the coupling is low. The basic antenna element is the same as shown in FIG. 6. A set of such elements Fp1, Fp2, . . . Fpi are stacked upon one another. One part of each Fpi is also a part of Fpi+1 and Fpi−1. The common parts will help to define the related capacitances $C_i$. The entire structure may have a common feeding point at Fp1 or separate feeding points may be located at Fp2. . . Fpi.

It is interesting to note that the width of the antenna structure does not have a critical influence on either the resonant frequency or the bandwidth. There is an optimum width for which the bandwidth of the basic element is at a maximum. Beyond this, the bandwidth does not increase as the width is increased.

The limited effect of the antenna width on bandwidth allows consideration of the structure shown in FIGS. 15*a–b*, which nests the individual antenna elements in both the vertical and horizontal directions. This allows more freedom in organizing the capacitive and inductive loading. This arrangement provides for the total inclusion of the inner antenna elements within the overall antenna volume, each element sharing a common ground. At different frequencies, only one element is resonating.

Figure 16:
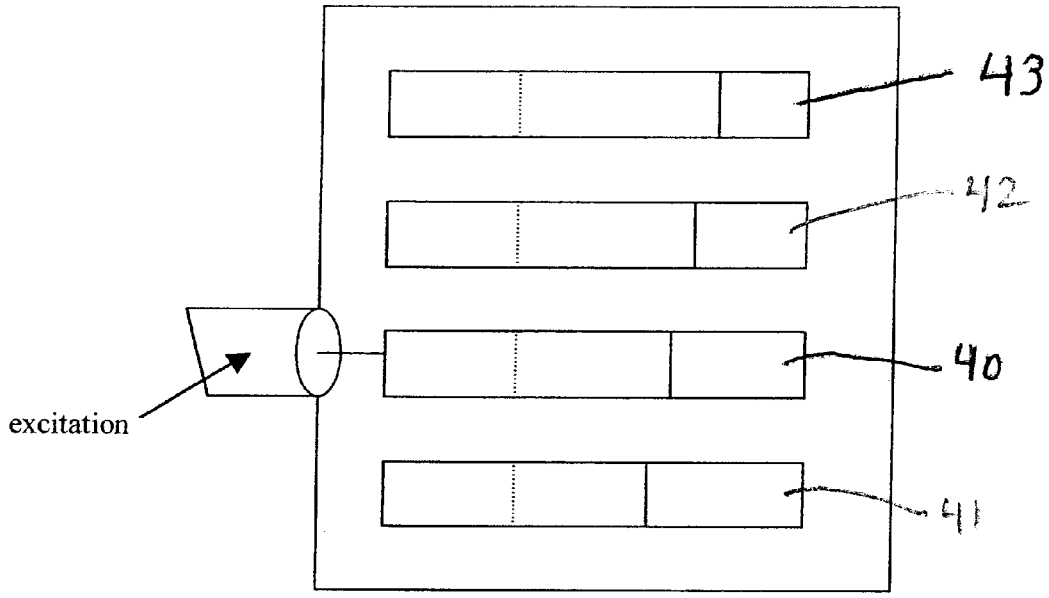
FIG. 16 diagrammatically illustrates a multiresonant antenna structure with parasitic elements.

FIG. 16 illustrates an antenna structure comprising an array of elements, each of the general type shown in FIG. 6, having a driven element 40 and adjacent parasitic elements 41–43. Impedance matching of this structure is illustrated by the Smith chart shown in FIG. 17. The large outer loop 50 corresponds to the main driven element 40, whereas the smaller loops 51–53 correspond to the parasitic elements. This is a representation of a non-optimized structure. Various adjustments can be made to the antenna elements to influence the positions of the loops on the Smith chart. The smaller loops may be gathered in the same area in order to obtain a constant impedance within the overall frequency range.

In the case of a typical 50 ohm connection, an optimized structure will have all of the loops gathered approximately in the center of the Smith chart as shown in FIG. 18. In order to gather the loops in the center of the Smith chart (or wherever it is desired to place them), the dimensions of the individual antenna elements are adjusted, keeping in mind that each loop corresponds to one element.

Figure 19:
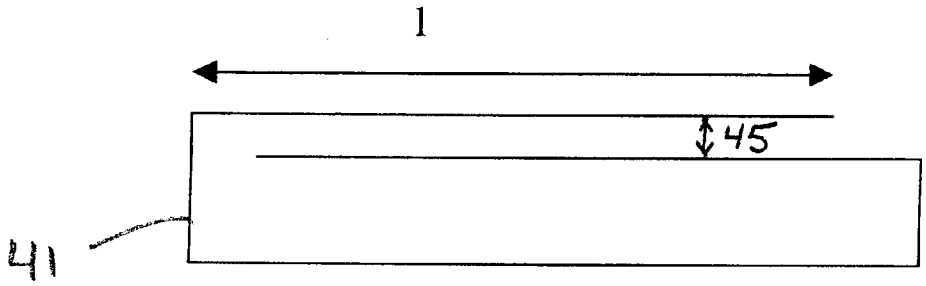
FIG. 19 is a side view of one of the elements of the antenna structure of FIG. 16.

FIG. 19 illustrates a single element, such as 41, of the antenna structure shown in FIG. 16. By reducing the dimension 1, the corresponding loop rotates clockwise on the Smith chart. By adjusting the length of the parasitic elements, all of the different loops can be gathered. Then, if necessary, the group of loops can be rotated back in the counter-clockwise direction on he Smith chart by reducing the length of the main driven element.

Figure 20:
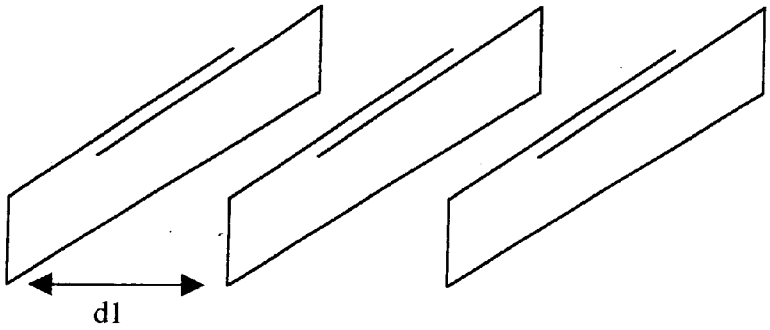
FIG. 20 illustrates optimization of the coupling of the elements of the antenna structure of FIG. 16.

In order to optimize the bandwidth of the antenna structure, the main loop must have a large enough diameter. With reference to FIG. 20, the diameter of the main loop is controller by the amount of coupling between each element and its neighbor, which is determined by the distance d1 between the adjacent elements. The amount of coupling is also controlled by the with of the elements. The narrower the elements are, the closer the elements can be in order to keep the same loop diameter. The ultimate size reduction is obtained when each element comprises a single wire. Furthermore, the elements can also be placed closer together by making the gap 45 smaller.

Finally, the main loop may be centered on the Smith chart by adjusting the location of the antenna feed on the main driven element. Referring to FIG. 21, impedance matching of the antenna structure is optimized by adjusting the dimension 1f. By increasing 1f, the diameter f the main loop is increased. In this way, the small loops can be centered at the desired location on the Smith chart.

FIG. 22 illustrates a polarized multi-resonant antenna structure in which polarization diversity is achieved through the use of two interleaved arrays of antenna elements. In the case illustrated, the two arrays are arranged orthogonally to provide orthogonal polarization. The two arrays may be interconnected in various ways or they may be totally separated. It is easiest to have the arrays make contact where they cross, otherwise the manufacturing is more difficult. However it is not necessary that the arrays contact one another, and, in some cases, isolating the array elements from each other can be used for adjusting the impedance matching characteristics of the antenna. In any case, it is always possible to match the antenna by adjusting the various dimensions of the array elements as discussed earlier.

The use of one- or two-dimensional arrays of antenna elements allows the antenna structure to be co-located on a circuit board with other electronic components. The individual array elements can be placed between components mounted on the board. The electronic behavior of the components may be slightly affected by the presence of the radiating elements, but this can be determined through EMC studies and appropriate corrective measures, such as shielding of sensitive components, may be implemented. However, the electronic components will generally not perturb the electromagnetic field and will therefore not change the characteristics of the antenna.

The two-dimensional array shown in FIG. 22 can be extrapolated to other array designs as illustrated in FIGS. 23*a–d*. The elements of the array can be arranged in various configurations to achieve spatial and/or polarization diversity. Other configurations in addition to those shown in FIGS. 23*a–d* are possible. In each case, the elements of the array may be interconnected in various ways or may be electrically isolated from one another. In addition, the individual elements may or may not be shorted to ground. All of these design parameters, including those previously discussed, permit the design of an antenna structure having the desired electromagnetic characteristics.

The design of an antenna structure must, of course, take into account manufacturing considerations, the objective being to achieve an antenna with both high efficiency and a low manufacturing cost. In achieving this objective, the problem of loss maybe a big issue. The electric field inside the capacitive part of the antenna is very high. Therefore, no material should be in between the two metallic layers.

Figure 24:
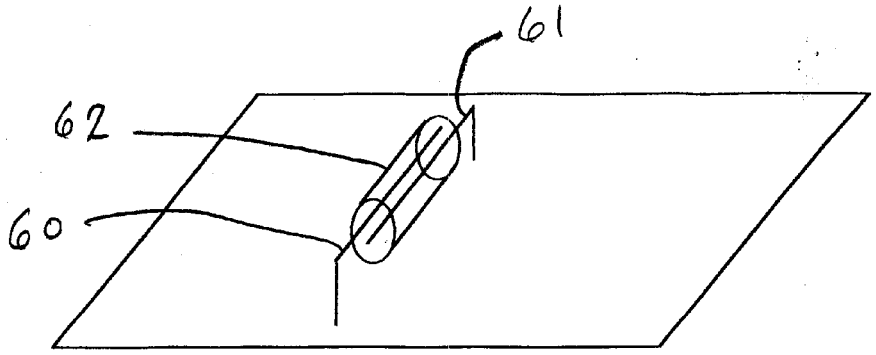
FIG. 24 illustrates a physical embodiment of a radiating element for the antenna structures of FIGS. 22–23.

A first solution, as illustrated in FIG. 24, utilizes an antenna element consisting of two wires 60, 61 connected to a ground. The distance between the two wires is very important for frequency tuning. Therefore, it is important to have a spacer that maintains the two wires at a fixed distance. In order to minimize the loss contributed by the presence of the spacer, the spacer should not intrude into the space between the wires. FIG. 24 shows a simple solution configured like a conventional surface mounted resistor. The wires are secured within a plastic hollow cylinder 62 and the protruding wires are then soldered to the ground.

Figure 25:
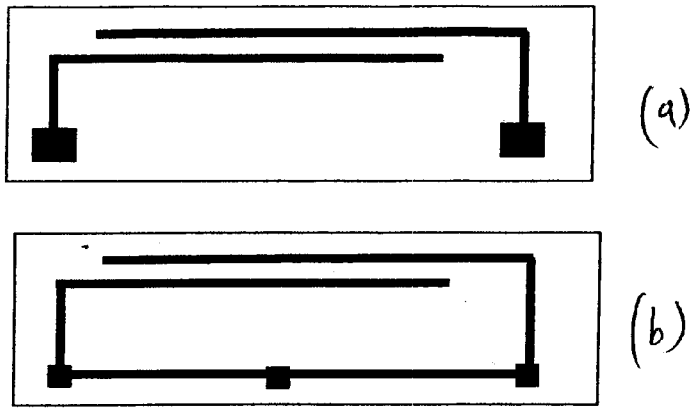
FIGS. 25*a* and 25*b* illustrate alternative physical embodiments of radiating elements for the antenna structures of FIGS. 22–23.

A second solution, as illustrated in FIGS. 25*a–b*, utilizes an antenna element constructed as a printed circuit. Each element is printed on a very thin, low-loss dielectric substrate in order to achieve good efficiency. The printed circuit element is then placed vertically on the ground. FIG. 25*a* shows a simple two-arm element. FIG. 25*b* shows a similar two-arm element with the ground printed on the substrate.

Figure 26:
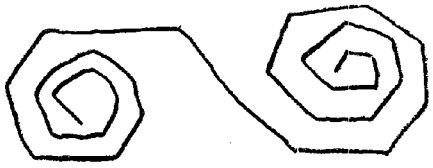
FIG. 26 illustrates a parasitic antenna element having a spiral configuration.

The parasitic elements of the antenna array need not be limited to the basic two-wire design shown in FIGS. 5 and 6 and in the later described structures based on these elements. Referring to FIG. 26, the parasitic elements may instead have a spiral configuration. The resonant frequency of the spiral element will be a function of the number of turns. It should be noted that when such a spiral element is coupled to a driven element having the configuration shown in FIG. 5 or FIG. 6, the capacitive coupling is reduced since the driven element acts as a dipole, whereas the spiral element acts as a quadrupole.

It will be recognized that the above-described invention may be embodied in other specific forms without departing from the spirit or essential characteristics of the disclosure. Thus, it is understood that the invention is not to be limited by the foregoing illustrative details, but rather is to be defined by the appended claims.

What is claimed is:

1. An antenna comprising:

a ground plane;

a first conductor extending longitudinally parallel to the ground plane having a first end electrically connected to the ground plane and a second end;

a second conductor extending longitudinally parallel to the ground plane having a first end electrically connected to the ground plane and a second end spaced apart from the second end of the first conductor;

an antenna feed coupled to the first conductor;

wherein at least one of the first and second conductors is slotted longitudinally; and wherein the first and second conductors are not equidistant from the ground plane.

2. The antenna of claim 1 wherein the respective second ends of the first an( second conductors overlap.

3. The antenna of claim 2 further comprising a third conductor extending longitudinally parallel to the ground plane having a first end electrically connected to the first conductor and a second end overlapping the second end of the second conductor.

4. The antenna of claim 3 further comprising a fourth conductor extending longitudinally parallel to the ground plane having a first end electrically connected to the second conductor and a second end overlapping the second end of the third conductor.

5. The antenna of claim 4 wherein the first end of the fourth conductor is aligned longitudinally with the first end of the second conductor.

6. The antenna of claim 1 wherein both of the first and second conductors are slotted to define a plurality of parallel radiating elements, each comprising a portion of the first conductor a corresponding portion of the second conductor, and wherein each portion of the first conductor has a respective second end spaced apart from a second end of a respective portion of he second conductor defining a gap for the respective radiating element.

7. The antenna of claim 6 wherein the gap of at least one of the radiating elements is displaced longitudinally from the gap of another radiating element.

8. The antenna of claim 7 wherein the respective second ends of the first and second conductors overlap.

9. The antenna of claim 1 wherein the slotted conductor comprises a central portion extending from the first end of the conductor toward the second end of the conductor and a pair if outboard fingers extending longitudinally from the second end of the conductor toward the first end of the conductor.

10. An antenna comprising:

a ground plane;

a first conductor extending longitudinally parallel to the ground plane having a first end electrically connected to the ground plane and a second end;

a second conductor extending longitudinally parallel to the ground plane having a first end electrically connected to the ground plane and a second end spaced apart from the second end of the first conductor;

a third conductor extending longitudinally parallel to the ground plane having a fist end electrically connected to the ground plane and a second end spaced apart from the second ends of the first and second conductors;

a fourth conductor extending longitudinally parallel to the ground plane having a first end electrically connected to the ground plane and a second end spaced apart from the second ends of the first, second and third conductors; and an antenna feed coupled to at least one of the first and third conductors.

11. The antenna of claim 10 wherein the first and third conductors are in a stacked relationship and wherein the second and fourth conductors are in a stacked relationship.

12. An antenna comprising a ground plane;

a first conductor extending longitudinally parallel to the ground plane having a first end electrically connected to the ground plane and a second end;

a second conductor extending longitudinally parallel to the ground plane having a first end electrically connected to the ground plane and a second end overlapping the second end of the first conductor;

a third conductor extending longitudinally parallel to the ground plane having a first end electrically connected to the ground plane and a second end overlapping the second conductor;

an antenna feed coupled to the first conductor.

13. An antenna comprising:

a ground plane;

an array of radiating elements, each of the radiating elements having a first conductor extending longitudinally parallel to the ground plane having a first end electrically connected to the ground plane and a second end, and a second conductor extending longitudinally parallel to the ground plane having a first end electrically connected to the ground plane and a second end spaced apart from the second end of the first conductor;

an antenna feed coupled to the first conductor of at least one of the radiating elements; and wherein the first and second conductors of each radiating element are not equidistant from the ground plane.

14. The antenna of claim 13 wherein the respective second ends of the first and second conductors overlap.

15. The antenna of claim 13 wherein the radiating elements are arranged in a parallel array.

16. The antenna of claim 13 wherein the radiating elements are arranged in a first parallel subarray and a second parallel subarray orthogonal to the first subarray.

17. The antenna of claim 13 wherein the radiating elements are arranged in a non-parallel array.

18. The antenna of claim 13 further comprising a radiating element having a conductor with a spiral configuration.

19. The antenna of claim 13 wherein the radiating elements comprise first and second conductive wires held in a spaced apart relationship.

20. The antenna of claim 19 wherein the first and second conductive wires are held if the spaced apart relationship by a non-conductive tubular element.

21. The antenna of claim 13 wherein the radiating elements comprise printed circuit boards.

22. An antenna comprising:

a ground plane;

a first conductor extending longitudinally parallel to the ground plane having a first end electrically connected to the ground plane and a second end;

a second conductor extending longitudinally parallel to the ground plane having a first end electrically connected to the ground plane and a second end spaced apart from the second end of the first conductor;

an antenna feed coupled to the first conductor;

wherein both of the first and second conductors are longitudinally slotted to define a plurality of parallel radiating elements, each comprising a portion of the first conductor and a corresponding portion of the second conductor, and wherein each portion of the first conductor has a respective second end spaced apart from a second end of a respective portion of the second conductor defining a gap for the respective radiating element; and wherein the gap of at least one of the radiating elements is displaced longitudinally from the gap of another radiating element.

23. The antenna of claim 22 wherein the respective second ends of the first and second conductors overlap.

24. An antenna comprising:

a ground plane;

an array of radiating elements, each of the radiating elements having a first conductor extending longitudinally parallel to the ground plane having a first end electrically connected to the ground plane and a second end, and a second conductor extending longitudinally parallel to the ground plane having a first end electrically connected to the ground plane and a second end spaced apart from the second end of the first conductor;

an antenna feed coupled to the first conductor of at least one of the radiating elements; and wherein the radiating elements comprise first and second conductive wires held in a spaced apart relationship by a non-conductive tubular element.

* * * * *

UNITED STATES PATENT AND TRADEMARK OFFICE

CERTIFICATE OF CORRECTION

PATENT NO. : 6,456,243 B1 
DATED : September 24, 2002
INVENTOR(S) : Gregory Poilasne, Laurent Desclos and Sebastian Rowson It is certified that error appears in the above-identified patent and that said Letters Patent is hereby corrected as shown below:

Column 1,
Line 9, "No. 09/901,134" should be -- No. 09/801,134 --.

Signed and Sealed this

Fourth Day of November, 2003

JAMES E. ROGAN
*Director of the United States Patent and Trademark Office*